US005510313A

United States Patent [19]

Hann et al.

[11] Patent Number: 5,510,313

[45] Date of Patent: Apr. 23, 1996

[54] THERMAL TRANSFER PRINTING DYESHEET

[75] Inventors: Richard A. Hann; Kenneth A. D. Mcallister, both of Ipswich, England

[73] Assignee: Imperial Chemical Industries PLC, London, England

[21] Appl. No.: 387,842

[22] PCT Filed: Aug. 19, 1993

[86] PCT No.: PCT/GB93/01761

§ 371 Date: May 4, 1995

§ 102(e) Date: May 4, 1995

[87] PCT Pub. No.: WO94/04369

PCT Pub. Date: Mar. 3, 1994

[30] Foreign Application Priority Data

Aug. 21, 1992 [GB] United Kingdom ..... 9217799

[51] Int. Cl.[6] ..... B41M 5/035; B41M 5/38

[52] U.S. Cl. ..... 503/227; 428/195; 428/913; 428/914

[58] Field of Search ..... 8/471; 428/195, 428/913, 914; 503/227

[56] References Cited

U.S. PATENT DOCUMENTS 203,056 11/1986 Polaroid ..... 430/138

270,677 6/1988 Dai Nippon ..... 430/200

FOREIGN PATENT DOCUMENTS 0203056 11/1986 European Pat. Off. .

0270677 6/1988 European Pat. Off. .

OTHER PUBLICATIONS

Spencer, D. A., "Color Photography in Practice", London, Pitman and Sons Limited, 3rd ed., Chap. 17, pp. 322–329.

D. A. Spencer "Colour Photography in Practice" 13 Dec. 1948, Sir Isaac Pitman & Sons Limited, London, G.B. 3rd Edition, Chapter 17, pp. 322–329 See p. 323, Line 14–Line 28.

*Primary Examiner*—B. Hamilton Hess

*Attorney, Agent, or Firm*—John M. Sheehan

[57] ABSTRACT

A thermal transfer dyesheet comprising an elongated substrate supporting print-size portions of first, second and third colour dyecoats arranged in a repeated sequence, said dyecoats each comprising one or more thermal transfer dyes dissolved or dispersed in a polymeric binder, characterised in that at least one of the second and third colour dyecoats has a clawback factor in respect of the first or second colour respectively, with a value in the range 1±0.3.

4 Claims, No Drawings

THERMAL TRANSFER PRINTING DYESHEET

The invention relates to dyesheets for thermal transfer printing, and especially to dyesheets capable of providing prints with good colour rendition.

Thermal transfer printing is a generic term for processes in which one or more thermally transferable dyes are caused to transfer from a dyesheet to a receiver in response to thermal stimuli. Using a dyesheet comprising a thin substrate supporting a dyecoat containing one or more dyes uniformly spread over an entire printing area of the dyesheet, printing can be effected by heating selected discrete areas of the dyesheet while the dyecoat is pressed against a dye-receptive surface of a receiver sheet, thereby causing dye to transfer to corresponding areas of the receiver. The shape of the pattern transferred is determined by the number and locations of the discrete areas which are subjected to heating. Full colour prints can be produced by printing with different coloured dyecoats sequentially in like manner, and the different coloured dyecoats are usually provided as discrete uniform print-size areas in a repeated sequence along the same dyesheet.

High resolution photograph-like prints can be produced by thermal transfer printing using appropriate printing equipment, such as a programmable thermal print head or laser printer, controlled by electronic signals derived from a video, computer, electronic still camera, or similar signal generating apparatus. A typical thermal print head has a row of tiny selectively energizable heaters, spaced to print six or more pixels per millimeter, often with two heaters per pixel. Laser printers require absorbers to convert the laser radiation to heat, usually in or under the dyecoat, and similarly produce the print by transferring dyes to the receiver pixel by pixel.

Like colour printing of various other technologies, thermal transfer printing is based on a subtractive three colour system, using yellow, magenta and cyan colours (not precluding the addition of black). In addition to their characteristic absorptions in the green, magenta dyes typically provide substantial blue absorption, and cyan dyes typically have substantial absorption of green wavelengths in addition to their characteristic absorption of red light. Yellow dyes absorb in the blue to provide their characteristic colour, and the additional absorptions at shorter wavelengths are generally outside the visible region, so do not contribute to the colour perceived.

Although such dyes may have good colour on their own, when they are mixed to produce other colours, these additional shorter wavelength absorptions can become a problem, in that they can distort the colour rendition obtained. Thus for example, yellow and magenta dyes are combined to produce red, but a high blue absorption by the magenta will provide a yellowness in addition to that of the yellow dye used, with a consequence that the resulting red will be more orange than would otherwise be the case. In addition to a distorted colour balance, the colour rendition can suffer from a dullness, where the colours appear less bright and the prints thereby less appealing.

This phenomenon is neither new nor confined to thermal transfer printing, and various correction techniques have previously been developed in the various different colour reproducing technologies, such as the masking used in conventional colour printing, for example. In thermal transfer printing, colour correction can be obtained by matrixing, a technique in which the control signals to the printer are adjusted for each pixel so as to correct the amount of each dye transferred in a manner and to an extent which compensates for any other corresponding absorption transferred in another dye to that same pixel, either before or subsequently. Thus, using the above example as illustration, the orangeness of the red may be corrected by transferring less of the yellow dye, where it is to be overprinted with the magenta having high absorption in the blue, whereas elsewhere the full amount of yellow is transferred by applying the yellow control signal unadjusted.

As will be appreciated, such corrections are complex, depending not only on whether there will be overprinting by either of the other dyes and whether such dyes have relevant unwanted absorptions, but also on what amounts of those other dyes are to be transferred to that pixel. The adjustment for each colour needs to be recalculated and applied to the control signal for each pixel, of which there are typically about 0.4 to 1.5 million per A4 sheet, depending on the resolution of the printing. Moreover, the program controlling such corrections also needs to be changed for different manufacturer's dyesheets because of their different chemical compositions.

We have now devised a dyesheet which makes such corrections automatically, and hence avoids any requirement to correct the control signals in the known manner described above. This is based on two discoveries. The first is that where one colour is overprinted by another, clawback occurs in which some of the previously transferred dye is removed from the receiver while the other dye is being transferred to the same pixel. Thus to use the same illustration as before, while magenta dye is being transferred to one of the pixels of the print, some of the previously printed yellow dye is removed from that same pixel by clawback, and the degree of clawback is a property of the dyesheet composition. The second discovery was that the amount of clawback which occurs with a given dyesheet is proportional to the amount of the later dye transferred, and not on the amount of the earlier dye for which the clawback is occurring. Thus again using the same example to illustrate this, we find that the more blue absorption capacity which is added to a pixel as an unwanted side effect of the magenta dye, the greater is the amount of blue absorption lost by clawback of the yellow dye by the same operation. We have now been able to use these two observations to select the novel compositions defined below, which automatically compensate for the presence of these unwanted absorptions by clawback.

Accordingly, the present invention provides a dyesheet comprising an elongated substrate supporting print-size portions of first, second and third colour dyecoats arranged in a repeated sequence, said dyecoats each comprising one or more thermal transfer dyes dissolved or dispersed in a polymeric binder, characterised in that at least one of the second and third colour dyecoats has a clawback factor in respect of the first or second colour respectively, with a value in the range $1\pm0.3$.

Thus where the dyesheet has the colours arranged in the conventional order of yellow, magenta and cyan, that referred to above as "first" will be yellow, "second" will be magenta, and "third" will be cyan.

The clawback factor is calculated by printing the first colour to a density of 1.4 then overprinting this with a gradient of the second colour. The optical density (OD) loss due to clawback is defined as the difference between the sum of the densities of the two colours separately and the density of the overprint. The clawback factor is the gradient of the OD loss against the unwanted overprint density and is found by performing a linear regression on the data. If the clawback factor were 1, then the effect of clawback would compensate for the unwanted density of the overprint dye. We have found that dyesheets with clawback factors in the range 1±0.3, for at least one, preferably both, of the pairs of adjacent colours, leads to prints with good colour rendition. The clawback factor of the first colour when printing the third, normally the yellow-cyan clawback, is generally less significant, but we still prefer a first-third colours clawback factor similarly to fall within that specified range.

The nearer the value of 1 that the clawback factors become, the better the colour rendition, and we particularly prefer that at least one, but preferably all, lie within the range 1 ±0.1.

EXAMPLES

The invention is illustrated by a comparison of a first dyesheet (Dyesheet A) prepared according to the invention and observed to give prints of good colour rendition, and a second (Dyesheet B) which was a known commercially available dyesheet that gave prints with a visible colour imbalance. Taking pairs of colours in turn, and printing one at varying densities onto the other preprinted at a standard density, clawback factors were calculated from the measured optical densities in the manner described above. A measurement of the unprinted receiver was also made, and subtracted from the print's optical densities to eliminate any off-white bias that may be contributed by the receiver.

The receiver used in these measurements had a substrate of 150 μm Melinex 990, ICI's white polyester film, and receiver coat of the following composition:

| | |
|---|---|
| Vylon 200 | 100 parts by weight |
| Cymel 303 | 1.4 parts by weight |
| Tegomer H—Si 2210 | 0.7 parts by weight |
| catalyst | 0.4 parts by weight |
| Tinuvin 900 | 1.0 parts by weight |

wherein Vylon 200 is a dye-receptive linear polyester from Toyobo. Cymel 303 is a hexamethoxymethylmelamine oligomer sold by American Cyanamid. Tegomer HSi 2210 is a bis-hydroxyalkyl polydimethylsiloxane sold by Goldshmidt and is cross-linkable by the Cymel 303 under acid conditions. The catalyst used was a blocked p-toluene sulphonic acid, and Tinuvin 900 is a UV stabiliser. The results are shown in the tables below.

Dyesheet A
Yellow-Magenta Clawback
Macbeth TR1224 Densitometer - Blue Filter Readings

| | | | Adjusted For White | | | |
|---|---|---|---|---|---|---|
| Yellow | Magenta | Red | Yellow | Magenta | Red | OD Loss |
| 1.42 | 0.12 | 1.32 | 1.33 | 0.03 | 1.23 | 0.13 |
| 1.41 | 0.17 | 1.38 | 1.32 | 0.08 | 1.29 | 0.11 |
| 1.45 | 0.23 | 1.4 | 1.36 | 0.14 | 1.31 | 0.19 |
| 1.46 | 0.34 | 1.34 | 1.37 | 0.25 | 1.25 | 0.37 |
| 1.45 | 0.43 | 1.36 | 1.36 | 0.34 | 1.27 | 0.43 |

-continued

Dyesheet A
Yellow-Magenta Clawback
Macbeth TR1224 Densitometer - Blue Filter Readings

| | | | Adjusted For White | | | |
|---|---|---|---|---|---|---|
| Yellow | Magenta | Red | Yellow | Magenta | Red | OD Loss |

White 0.09
Yellow-Magenta Clawback Factor = 1.11

Yellow-Cyan Clawback
Macbeth TR1224 Densitometer - Blue Filter Readings

| | | | Adjusted For White | | | |
|---|---|---|---|---|---|---|
| Yellow | Cyan | Green | Yellow | Cyan | Green | OD Loss |
| 1.35 | 0.12 | 1.3 | 1.26 | 0.03 | 1.21 | 0.08 |
| 1.37 | 0.17 | 1.31 | 1.28 | 0.08 | 1.22 | 0.14 |
| 1.38 | 0.24 | 1.3 | 1.29 | 0.15 | 1.21 | 0.23 |
| 1.42 | 0.31 | 1.28 | 1.33 | 0.22 | 1.19 | 0.36 |
| 1.42 | 0.4 | 1.3 | 1.33 | 0.31 | 1.21 | 0.43 |
| 1.45 | 0.55 | 1.45 | 1.36 | 0.46 | 1.36 | 0.46 |

White 0.09
Yellow-Cyan Clawback Factor = 0.94

Magenta-Cyan Clawback
Macbeth TR1224 Densitometer - Green Filter Readings

| | | | Adjusted For White | | | |
|---|---|---|---|---|---|---|
| Magenta | Cyan | Blue | Magenta | Cyan | Blue | OD Loss |
| 1.33 | 0.17 | 1.34 | 1.25 | 0.09 | 1.26 | 0.08 |
| 1.38 | 0.24 | 1.38 | 1.3 | 0.16 | 1.3 | 0.16 |
| 1.39 | 0.36 | 1.4 | 1.31 | 0.28 | 1.32 | 0.27 |
| 1.39 | 0.49 | 1.44 | 1.31 | 0.41 | 1.36 | 0.36 |
| 1.42 | 0.64 | 1.52 | 1.34 | 0.56 | 1.44 | 0.46 |
| 1.42 | 0.92 | 1.56 | 1.34 | 0.84 | 1.48 | 0.7 |

White 0.08
Magenta-Cyan Clawback Factor = 0.80

Dyesheet B
Yellow-Magenta Clawback
Macbeth TR1224 Densitometer - Blue Filter Readings

| | | | Adjusted For White | | | |
|---|---|---|---|---|---|---|
| Yellow | Magenta | Red | Yellow | Magenta | Red | OD Loss |
| 1.34 | 0.12 | 1.39 | 1.26 | 0.04 | 1.31 | −0.01 |
| 1.37 | 0.22 | 1.41 | 1.29 | 0.14 | 1.33 | 0.1 |
| 1.4 | 0.35 | 1.45 | 1.32 | 0.27 | 1.37 | 0.22 |
| 1.43 | 0.49 | 1.5 | 1.35 | 0.41 | 1.42 | 0.34 |
| 1.44 | 0.62 | 1.59 | 1.36 | 0.54 | 1.51 | 0.39 |
| 1.41 | 0.76 | 1.71 | 1.33 | 0.68 | 1.63 | 0.38 |

White 0.08
Yellow-Magenta Clawback Factor = 0.64

Yellow-Cyan Clawback
Macbeth TR1224 Densitometer - Blue Filter Readings

| | | | Adjusted For White | | | |
|---|---|---|---|---|---|---|
| Yellow | Cyan | Green | Yellow | Cyan | Green | OD Loss |
| 1.4 | 0.1 | 1.29 | 1.32 | 0.02 | 1.21 | 0.13 |
| 1.36 | 0.17 | 1.31 | 1.28 | 0.09 | 1.23 | 0.14 |
| 1.37 | 0.25 | 1.33 | 1.29 | 0.17 | 1.25 | 0.21 |
| 1.38 | 0.35 | 1.37 | 1.3 | 0.27 | 1.29 | 0.28 |
| 1.38 | 0.47 | 1.44 | 1.3 | 0.39 | 1.36 | 0.33 |
| 1.39 | 0.6 | 1.54 | 1.31 | 0.52 | 1.46 | 0.37 |

White 0.08
Yellow-Cyan Clawback Factor = 0.52

Magenta-Cyan Clawback
Macbeth TR1224 Densitometer - Green Filter Readings

| | | | Adjusted For White | | | |
|---|---|---|---|---|---|---|
| Magenta | Cyan | Blue | Magenta | Cyan | Blue | OD Loss |
| 1.33 | 0.15 | 1.34 | 1.25 | 0.07 | 1.26 | 0.06 |
| 1.38 | 0.23 | 1.38 | 1.3 | 0.15 | 1.3 | 0.15 |
| 1.39 | 0.35 | 1.4 | 1.31 | 0.27 | 1.32 | 0.26 |
| 1.39 | 0.48 | 1.44 | 1.31 | 0.4 | 1.36 | 0.35 |
| 1.42 | 0.64 | 1.54 | 1.34 | 0.56 | 1.46 | 0.44 |
| 1.42 | 0.93 | 1.89 | 1.34 | 0.85 | 1.81 | 0.38 |

White 0.08
Magenta-Cyan Clawback Factor = 0.43

According to these results, Dyesheet A is a dyesheet according to the present invention, whereas Dyesheet B lies outside it.

The two dyesheets were also used to make full colour prints from the same control signals. No corrections were applied to these signals to compensate for differences in the dyes. The prints obtained from dyesheet A were noticeably brighter, appearing to have colours which were truer to the original scene, than those made using Dyesheet B. This subjective comparison showed the prints made with dyesheets according to the present invention, had a visibly improved colour rendition when compared with the prints we made in similar manner from Dyesheet B, a commercial dyesheet presently available on the market.

I claim:

1. A thermal transfer dyesheet comprising an elongated substrate supporting print-size portions of first, second and third colour dyecoats arranged in a repeated sequence, said dyecoats each comprising one or more thermal transfer dyes dissolved or dispersed in a polymeric binder, characterised in that at least one of the second and third colour dyecoats has a clawback factor in respect of the first or second colour respectively, with a value in the range 1±0.3; wherein clawback occurs when some of a dye previously transferred to a receiver is removed while being overprinted by a subsequent colour, and the clawback factor is the ratio of the optical density loss through clawback and the density of the subsequent colour at the same wavelength; the optical density loss being defined as the sum of the densities of the two colours separately minus the density of the overprint, at the wavelength characteristic of the previously transferred dye.

2. A dyesheet as claimed in claim 1, characterised in that both the second and third colour dyecoats have a clawback factor in respect of the first or second colour respectively, with a value in the range 1±0.3.

3. A dyesheet as claimed in claim 1, characterised in that both the second and third colour dyecoats have a clawback factor in respect of the first colour with a value in the range 1±0.3.

4. A dyesheet as claimed in any one of claims 1–3 characterised in that at least one of the three clawback factors has a value in the range 1±0.1.

* * * * *